US006891472B2

(12) United States Patent
Tallman

(10) Patent No.: US 6,891,472 B2
(45) Date of Patent: May 10, 2005

(54) TAUT WIRE WIRELESS PERIMETER FENCE SECURITY SYSTEM

(76) Inventor: Erven Tallman, 72420 Beverly Way, Rancho Mirage, CA (US) 92270

( * ) Notice: Subject to any disclaimer, the term of this patent is extended or adjusted under 35 U.S.C. 154(b) by 64 days.

(21) Appl. No.: 10/359,905

(22) Filed: Feb. 6, 2003

(65) Prior Publication Data

US 2003/0173557 A1 Sep. 18, 2003

Related U.S. Application Data

(60) Provisional application No. 60/354,854, filed on Feb. 6, 2002.

(51) Int. Cl.[7] ..... G08B 13/00

(52) U.S. Cl. ..... 340/541; 340/548; 340/564

(58) Field of Search ..... 340/541, 547, 340/548, 564, 686.1, 687, 686.2; 200/16 C, 42.01, 252

(56) References Cited

U.S. PATENT DOCUMENTS

| | | | | |
|---|---|---|---|---|
| 3,912,893 A | | 10/1975 | Stoler | |
| 3,932,718 A | * | 1/1976 | Porat | 200/61.93 |
| 4,500,873 A | * | 2/1985 | Porat et al. | 340/515 |
| 4,527,150 A | * | 7/1985 | Porat | 340/541 |
| 4,683,356 A | * | 7/1987 | Stoler | 200/61.93 |
| 4,703,313 A | * | 10/1987 | Husmann et al. | 340/550 |
| 4,730,809 A | | 3/1988 | Stoler | |
| 4,829,286 A | * | 5/1989 | Zvi | 340/541 |
| 5,103,207 A | | 4/1992 | Kerr et al. | |
| 5,371,488 A | | 12/1994 | Couch et al. | |
| 5,392,027 A | * | 2/1995 | Brunot et al. | 340/561 |
| 5,438,316 A | | 8/1995 | Motsinger et al. | |
| 5,440,498 A | | 8/1995 | Timm | |
| 5,461,364 A | | 10/1995 | Sanford, Jr. et al. | |
| 5,578,990 A | | 11/1996 | Sanford, Jr. et al. | |
| 5,602,534 A | | 2/1997 | Granat | |
| 5,852,402 A | * | 12/1998 | Perry | 340/541 |
| 6,578,438 B2 | * | 6/2003 | Steinberg et al. | 73/862.381 |

FOREIGN PATENT DOCUMENTS

CA 2301432 A1 * 10/2000 ..... E04H/17/02

* cited by examiner

*Primary Examiner*—Toan N. Pham
(74) *Attorney, Agent, or Firm*—Hahn Loeser & Parks LLP; W. Edward Crooks, Esq.

(57) ABSTRACT

The present invention is a taut wire security system that is used with a perimeter fencing system. The device senses changes in the tension in the taut wire and produces a tension signal when a disturbance in the tension is created. This signal is transmitted to a central location when such a tension deviation occurs. The housing of the device has two compartments, with the electronic components being substantially sealed from the atmosphere such that moisture, dirt or other elements do not cause the electronic components to malfunction. The device also includes a tampering sensor to detect whenever the lid of the device is being removed.

24 Claims, 8 Drawing Sheets

Fig. 1

TAUT WIRE WIRELESS PERIMETER FENCE SECURITY SYSTEM

CROSS-REFERENCE TO RELATED APPLICATIONS

This application claims the benefit of U.S. Provisional Application No. 60/354,854, filed Feb. 6, 2002. Application Ser. No. 60/354,854 is herein incorporated by reference.

FIELD OF THE INVENTION

The present invention is generally a security device for use with perimeter fencing systems. More specifically, the present invention is an in-line taut wire wireless perimeter fence security system.

BACKGROUND OF THE INVENTION

Perimeter fencing systems, such as a strand wire, barb wire or chain-link fences, have been used for ages to prevent access to select areas and/or to contain animals within a certain area. In some instances, it is desired to have additional levels of security than what is provided by a standard perimeter fence system. Various systems have been developed to increase the security provided by perimeter fences. Such systems have been developed to detect when a person climbs over a fence, when the fence or portion thereof has been cut, or when the perimeter fence has been otherwise tampered with, in an attempt to enter the security area or remove items therefrom.

An example of such a system is a taut wire security system which measures a disturbance upon one or more strands of wire which are associated with the perimeter fence. One type of a taut wire security system is a device which is in-line with the taut wire itself, and measures the tension within the taut wire. Upon a selected amount of change in tension or the taut wire, a signal is sent to a monitoring station indicating an intrusion or other disturbance. These prior art taut wire systems provide adequate additional security to the perimeter fence while being relatively easy to install and maintain.

However, these prior art in-line taut wire security systems suffer from several disadvantages. One such disadvantage is the inclusion of the electromechanical tension sensors within the same compartment as the electronic signaling components. In this instance, as moisture enters a single compartment enclosure, the moisture causes malfunctioning of the electronic signaling components.

Accordingly, there is a need to provide and in-line taut wire security system which separates the electromechanical tension sensors from the electronic signaling components, and prevents moisture from causing malfunctions of the electronic signaling components.

SUMMARY OF THE INVENTION

The present invention is a security apparatus and method for measuring the tension within a taut wire associated with a perimeter fence which produces an alarm condition upon measurement of a predetermined level of tension disturbance. The apparatus has an external housing with two compartments. In the first compartment there is located the electromechanical sensor which measures changes in the taut wire tension. Extending from the ends of the housing, are two opposing rods which interact with the tension sensor and interconnect the taut wire with the tension sensor. The second compartment houses the electronic signaling components which are electronically connected with the tension sensor, and transmit the alarm condition to the monitoring station. Optionally, the second compartment is provided with means for sealing the compartment from the environment and a one-way breather valve that allows any moisture which does enter the second compartment to dissipate. Alternatively, the electronic components may be housed within a separate enclosure affixed to the lid of the second compartment, which prevents moisture from contacting the electronic signaling components. Preventing moisture from contacting the electronic signaling components prevents these components from short circuiting, or otherwise malfunctioning.

Accordingly, it is an object of the present invention to provide a perimeter fence security system which measures changes in the tension within a taut wire associated with a perimeter fencing system.

It is another object of the present invention to provide the taut wire sensing apparatus which has two compartments in order to prevent moisture from coming into contact with the electronic signaling components.

It is a further object of the present invention to provide a taut wire sensing apparatus which incorporates It is yet another object of the present invention to provide a taut wire sensing apparatus which is easily installed and maintained in association with a perimeter fence.

These and other objects of the present invention will become apparent upon review of the detailed description of the invention and the appended drawings.

DETAILED DESCRIPTION OF THE PREFERRED EMBODIMENT

Reference will now be made in detail to the present preferred embodiments of the present invention, examples of which are illustrated in the accompanying drawings. Whenever possible, the same reference numbers will be used throughout the drawings to refer to the same or like parts.

Figure 1:
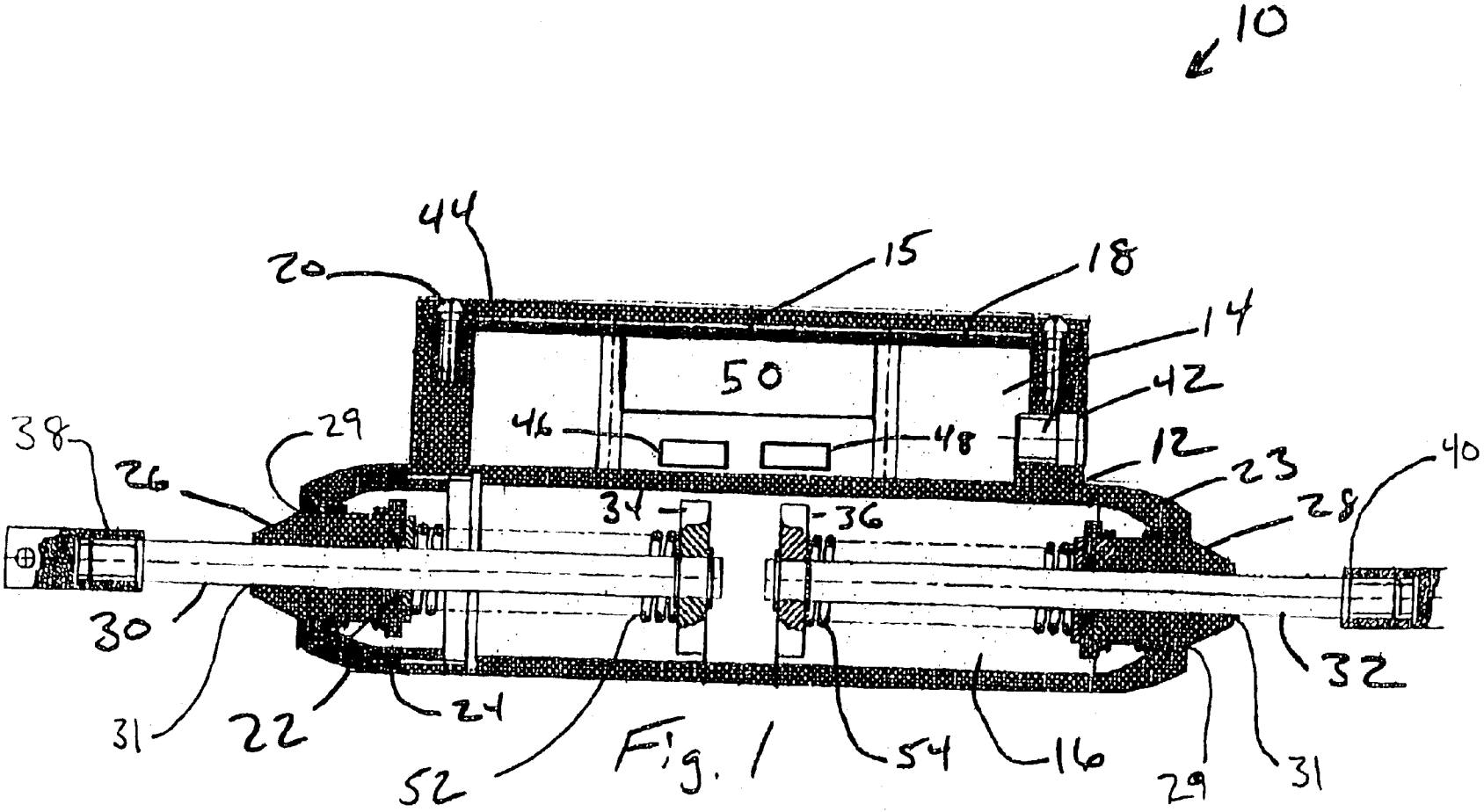
FIG. 1 is a side cross sectional view of a first embodiment of the present invention partially assembled.
Figure 4:
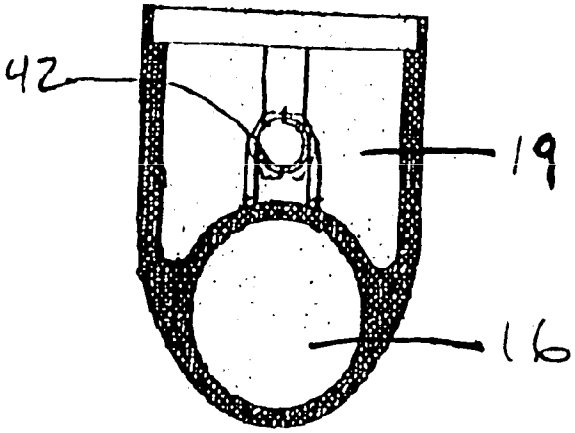
FIG. 4 is a front view of the housing of a first embodiment of the present invention.
Figure 2:
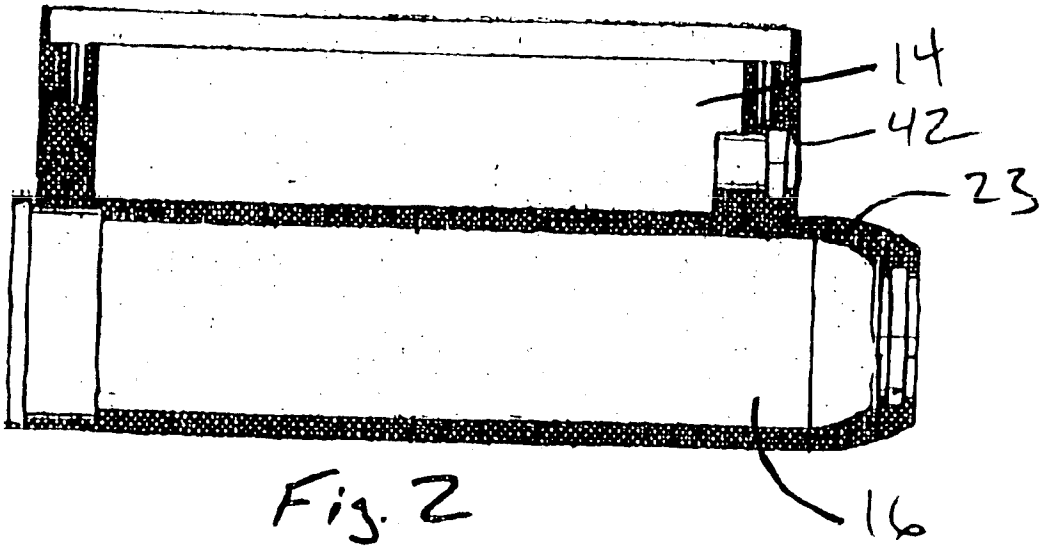
FIG. 2 is a side cross sectional view of housing of a first embodiment of the present invention.
Figure 3:
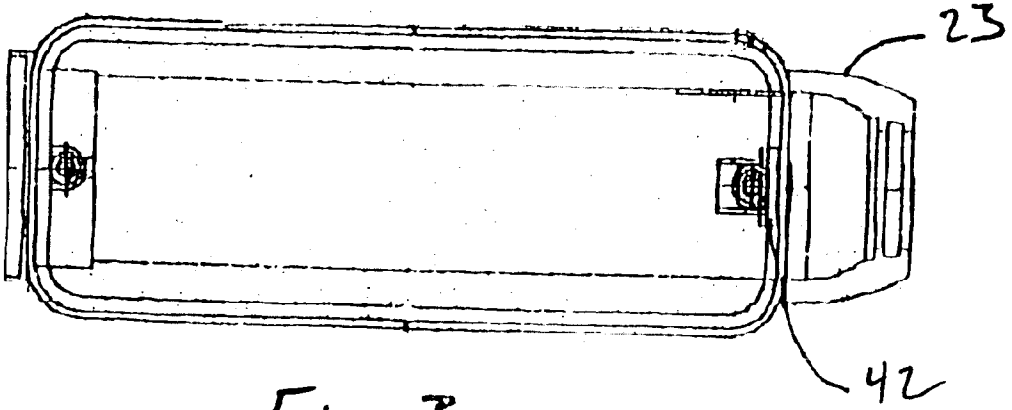
FIG. 3 is a top cross sectional view of the housing of a first embodiment of the present invention.

FIG. 1 shows a first embodiment of the taut wire security device of the present invention generally at 10. This first embodiment includes a housing 12 which comprises two separate compartments 14 and 16. Preferably, housing 12 is constructed from plastic materials which are durable and can withstand outdoor environments. Examples of the plastics which can be used include PVC, ABS or other polymeric materials with sufficient rigidity and ability to withstand extended periods in the outdoors. Compartment 14 houses the electronics utilized with the present invention, namely the transmitter and the reed or magnetic switches, discussed in detail below. Compartment 14 is enclosed by plate 15 which is fastened to housing 12 by means of fasteners 20 which engage inserts placed within the sidewalls of compartment 14. Preferably, the sidewall fastener inserts are constructed from brass. Optionally, fasteners may engage the sidewalls of compartment 14 directly, without the use of inserts. Interposed between plate 15 and housing 12 is a gasket 18, which effectively seals compartment 14 from the outside elements, particularly moisture. Compartment 14 may optionally include a breather valve 42 that allows any moisture which does enter compartment 14 to dissipate.

Alternatively to having a completely separate and sealed compartment 14, plate 15 may have an enclosure which is removeably attached to plate 15. This embodiment is illustrated in FIGS. 8 through 12. In this embodiment, plate 90 is provided with apertures 92 adapted for receiving fasteners utilized to attach plate 90 to housing 12. A gasket (not shown) is placed between plate 90 and housing 12, when assembled in order to prevent moisture and dirt from entering housing 12. Plate 90 is provided with tabs 94 which are adapted for engagement with pins 106 formed on enclosure 102. Plate 90 is also provided with an electronics attachment clip 96 and fastening block 98 which allow for attachment of the electronic transmitter 50 to the underside of plate 90. Also attached to the underside of plate 90 is magnet 100, which is used in sensing tampering with plate 90 by intruders, as is described in detail below.

Enclosure 102 is provided with pins 106 which extend outwardly from enclosure 102 and which engage tabs 94 for attaching enclosure 102 to plate 90. When assembled, a gasket (not shown) is positioned between enclosure 102 and plate 90, to prevent moisture from entering enclosure 102 and affecting the electronic components within enclosure 102. Enclosure 102 is also provided with inserts 104 for insertion and connection of electric wiring from the electromechanical components of the present invention, with the transmitter 50. Inserts 104 may be constructed from a variety of conductive materials, with the preferred material being brass. Inserts 104 are provided with fasteners (not shown) which provide proper contact with and retention of the electric wiring. Inserts 104 are bored so that a portion of material is left between the bores formed on each end of insert 104. Thus, moisture is prevented from entering enclosure 102. Like plate 15, plate 90 is secured by fasteners which engage brass inserts within the sidewalls of compartment 14.

Referring back to FIGS. 1 through 4, compartment 16 encloses the taut wire tension sensing means of the present invention. Compartment 16 is substantially cylindrical, although it may be formed in a variety of different configurations, and has opposite end portions 22 and 23. Preferably end portion 23 is integrally formed with housing 12, while end portion 22 is releasably attached to housing 12, although both end portions may be removable. A preferred manner to releasably attach end portion 22 to housing 12 is through threads formed on end portion 22 and housing 12. Interposed between end portion 22 and housing 12 is an o-ring 24 which seals compartment 16 from outside elements. Both end portions 22 and 23 include an aperture 29 formed therein which receive bushings 26 and 28 which fit around tension rods 30 and 32 as the rods enter compartment 16. Within these apertures are affixed o-rings 33 (shown in FIG. 13) which aid in preventing moisture, dirt and other elements from entering compartment 16. At the outer ends of rods 30, 32 are affixed couplers 38 and 40 which facilitate attachment of rods 22, 23 to ends of a taut wire. On the inner ends of rods 30, 32 are placed magnetic contacts 34, 36 which work in conjunction with reed switches in order to indicate an alarm condition.

Figure 13:
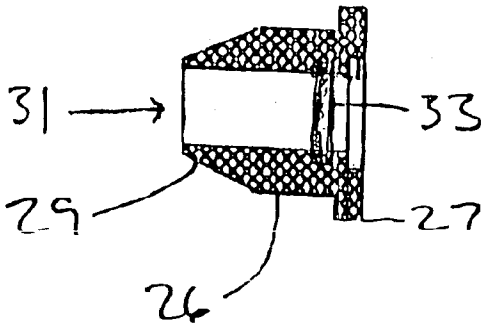
FIG. 13 is a side cross sectional view of a bushing for use with the present invention.

As shown in FIGS. 1 and 13, bushings 26 and 28 have a cylindrical main portion having a flange 27 on one end which extends radially outwardly, and a frustoconical end portion 29 opposite the flange. Bushings 26, 28 further have a central bore 31 formed therein, through which tension rods 30, 32 are positioned. Within bore 31 is provided a groove for placement of an o-ring 33, which prevents moisture and other elements from entering compartment 16. Positioned about bushings 26 and 28 are springs (not shown) which act against the inside of the apertures 29 formed in end portions 22 and 23. The flange portion 27 of bushings 26, 28 abuts a spring 52, 54 positioned about the inner portion of rods 30, 32. These rod springs 52, 54 act to position magnetic contacts 34, 36 relative to the reed switches 46, 48, when the taut wire device 10 is connected and under tension of the taut wire. When in position on the taut wire, magnetic contact 34, 36 are placed substantially below reed switches 46, 48.

Also shown in FIG. 1 is a first embodiment of the tension sensing means of the present invention. Housed within compartment 14 are reed switches 46 and 48, and transmitter 50. Reed switches 46 and 48 are electrically connected to transmitter 50, by means known in the electronic arts, including electrical wiring for example. Reed switches 46, 48 act in association with the magnetic contacts 34, 36 to determine an alarm condition. When in position on a taut wire, magnetic contacts 34, 36 are placed substantially below reed switches 46, 48 so that reed switches 46, 48 are in a closed position. Upon movement of magnetic contacts 34, 36 outwardly toward end portions 22, 23, or inwardly toward opposite magnetic contact, the magnetic forces acting upon reed switches 46, 48 are removed and the reed switches 46, 48 are opened. When either reed switch 46, 48 is opened, an alarm condition is created. Examples of events which may cause movement of magnetic contacts 34, 36, include a person climbing or pulling the taut wire, or cutting the taut wire completely. When an alarm condition is created, the reed switches 36, 38 electrically communicate with transmitter 50, which indicates an alarm condition to a centralized security station. Preferably, transmitter 50 wirelessly communicates with the central security station, although hard wired means of connecting transmitter 50 with the security station are also contemplated.

Figure 5:
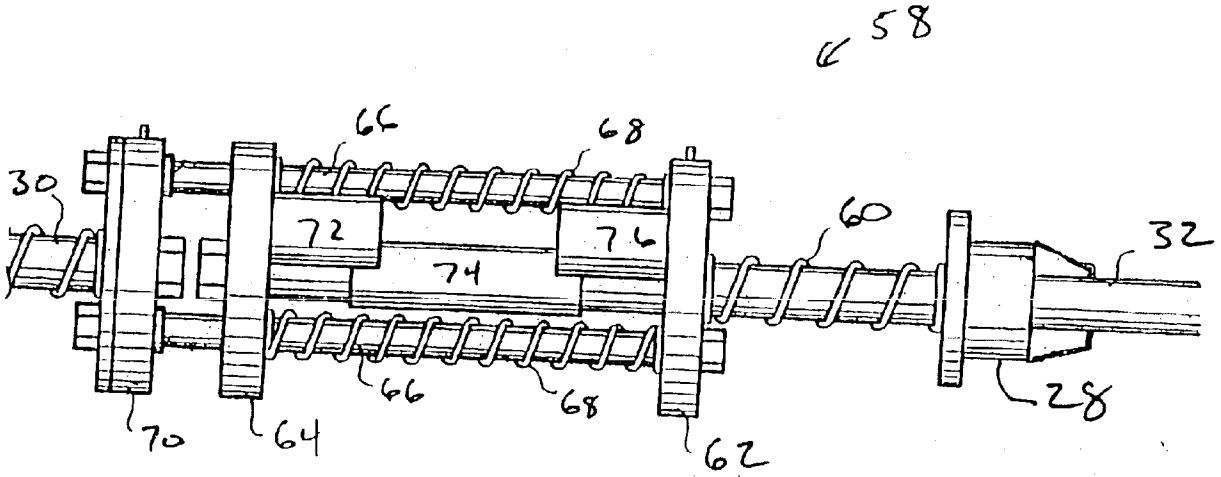
FIG. 5 is a side elevational view of a second embodiment of the tension sensing means of the present invention.
Figure 7:
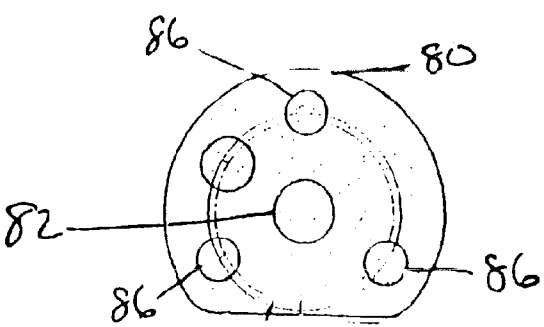
FIG. 7 is a bottom view of the sensing plates of a second embodiment of the tension sensing means of the present invention.
Figure 6:
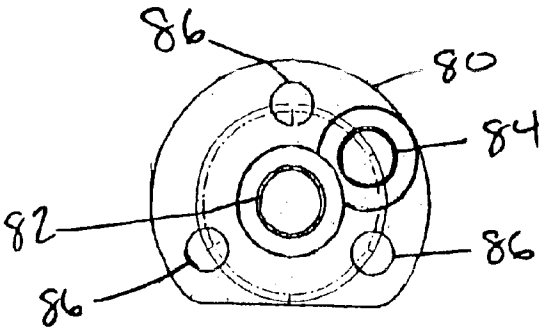
FIG. 6 is a top view of the sensing plates of a second embodiment of the tension sensing means of the present invention.
Figure 8:
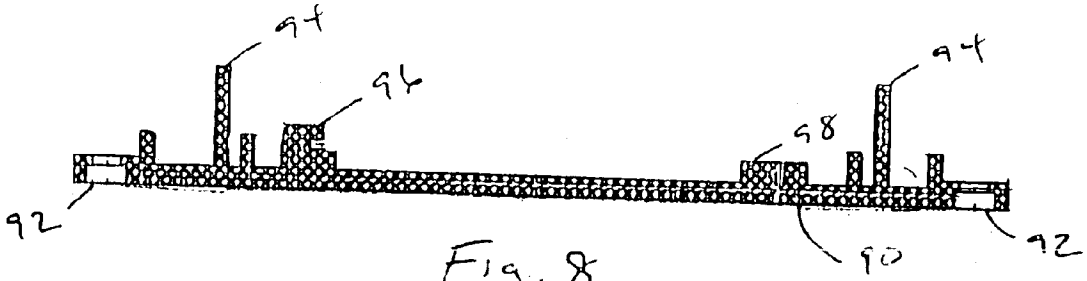
FIG. 8 front cross sectional view of a lid plate of the present invention.

Shown in FIGS. 5 through 7 is a second embodiment of the tension sensing means of the present invention. The second embodiment of the tension sensing means 58 includes a structure having a plurality of guide members 66 affixed between a first end plate 62 and a second end plate 70. Second end plate 70 is attached to tension rod 30. A moveable plate 64 is positioned upon guide members 66 in between end plates 62, 70, and is attached to tension rod 32. Tension rods 30 and 32 are in turn connected to taut wire couplers 38 and 40 (shown in FIG. 1). Biasing means comprised of a plurality of biasing springs 68 positioned upon the guide members 66, bias moveable plate 64 away from first end plate 62, and in opposition to the normal longitudinal tension in the taut wire.

As the tension sensing means 58 receives tension from the taut wire on each end, the tension draws the moveable plate 64 toward first end plate 62, compressing biasing springs 68. A spacer 74 is provided to prevent the over tensioning of tension sensing system 58. Tension sensing means 58 retains the longitudinal tension within the taut wire until the tension in the taut wire is released, allowing the biasing springs 68 to push the moveable plate 64 away from first end plate 62, and toward second end plate 70.

The first end plate 62 and the moveable plate 64 have tension sensing elements incorporated therein. First end plate 62 contains sensor element 76, while moveable plate 74 contains sensor element 72. Tension sensor elements 72, 76 are situated to produce an alarm signal when sensor element 72 moves out of a predetermined distance from sensor element 76. Preferably, tension sensors 72, 76 are comprised of a magnet and magnetically activated switch. The predetermined distance between sensor elements 72, 76 required to produce an alarm signal, may be as little as 3/8 of an inch.

Tension sensing means 58 produces an alarm signal when the taut wire is cut, as the magnet of sensor element 72 closes the switch of sensor 76, when the magnet is in close proximity to the switch. When the tension in the wire decreases sufficiently to move the magnet of element 72 out of the activating distance of the switch of element 76, the open circuit acts to create an alarm signal. Alternatively, when the tension sensing means 58 is situated to produce an alarm signal when an intruder puts weight on the taut wire, the switch of element 76 may be closed until the magnet of sensor 72 is pulled by the wire tension to within the activating distance of the switch of sensor element 72, at which point the switch opens to produce the desired alarm signal.

Preferably, the first and second tension sensing means as described herein, provide output circuitry that is electrically closed during normal operation. Further, such output circuitry preferably becomes electrically open when the respective sensor detects an alarm condition. During normal operation, the transmitting means 50 transmits a normal signal. However, when any of the sensor elements becomes electrically open, the transmitting means 50 transmits an alarm condition.

Figure 15:
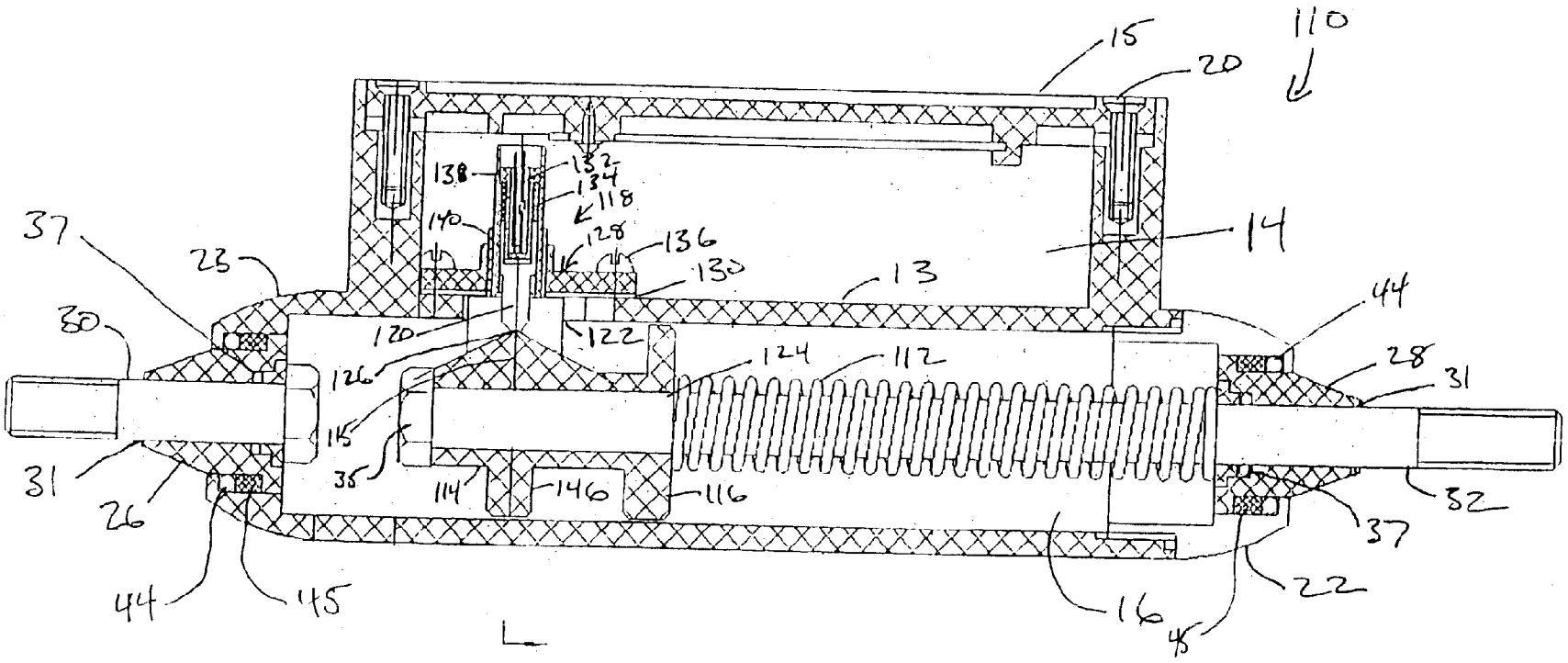
FIG. 15 is a side cross sectional view of a third embodiment of the tension sensing means of the present invention.

Now referring to FIG. 15, there is shown a third embodiment of the present invention, referenced generally as 110. This embodiment is incorporated into a two compartment housing 12, similar to the first and second embodiments. Like parts are identified with the same reference numerals.

Tension rods 30, 32 are connected in-line with a taut wire used in association with perimeter fence. Tension rods 30, 32, protrude out of the compartment 16 through apertures formed in bushings 26, 28, which are affixed at either end of housing 12. Positioned about bushings 26,28 are o-rings 44 which prevent moisture and dirt from entering mechanical compartment 16. Springs 45 are also positioned about bushings 26, 28, which act against bushings 26, 28 to place bushings at their outermost position. Bushings 26, 28, also include an o-ring 37 located within bore 31 to further aid in preventing moisture from entering the device. Compartment 16 includes a releasable end portion 22, as well as an integral end portion 23, which provide access to compartment 16. Optionally, two releasable end portions may be utilized.

Tension rods 30 remains in position adjacent bushing 26 when tension is applied to the taut wire. Tension rod 32 extends into compartment 16, and spring 112 is placed about rod 32. A spacer 114 is placed at the terminal or inner most end 35 of tension rod 32. Spacer 114 has a cam 115 and a base portion 116. Spacer 114 is positioned about tension rod 32 by means of an aperture 124 formed in spacer 114. Cam 115 is frusto-conical shaped and has a vertex 126 located proximate the midline of spacer 114. Base portion 116 extends axially from body portion 115 and maintains the position and orientation of spacer 114 within compartment 16. Spacer 114 cooperates with a mechanical reed switch 118, as described below.

Within compartment 14 is a tension sensor that works with the mechanical components of this embodiment to sense changes in tension within the taut wire, such as when the taut wire is flexed due to climbing or pulling on the wire or fence, or when the taut wire is cut. Mechanical reed switch 118 is spring activated and includes a structural housing or saddle 128, an enclosure 138, a magnet holder 140, a spring 134, a magnet 132, and a cone 120 which protrudes through an aperture 122 formed between the electronics compartment 14, and mechanical compartment 16. A gasket 130 is placed between saddle 128, and the compartment divider 13. Gasket 130 prevents moisture from entering the electronics compartment 14 from the mechanical compartment 16. Keeping moisture from coming in contact with the electrical components of the present invention maintains proper operation of the invention, and reduces maintenance costs in operating the device.

Saddle 128 is constructed from clear plastic such as ABS for example, such that the installer of the present invention can view the position of the spacer 114 in association with cone 120 for proper adjustment of the invention to measure changes in taut wire tension. Saddle 128 is affixed to the compartment divider 13 by means of fasteners, such as screws 136. Other means of fastening saddle 128 to divider 13 are contemplated, such as an adhesive for example.

Affixed to saddle 128 is enclosure 138, which forms a cavity for cone 120, spring 134, magnet 132 and magnet guide 140. Enclosure 138 is affixed to saddle 128 by corresponding male and female threads formed on the saddle 128 and enclosure 138, respectively. This creates a moisture proof seal, preventing moisture that may enter enclosure 138 through aperture 122 from contacting the electronic components, such as transmitter 50, and causing these components to malfunction.

The vertex 126 formed in spacer 114 engages cone 120 such that when the proper amount of tension is on the taught wire, vertex 126 forces cone 120 to its upper most position. In the event the taut wire is deflected causing spacer 114 to move toward the right within compartment 16, as shown in FIG. 15, cone 120 is disengaged and moves downwardly by application of spring 134. Similarly, if the tension is removed from the taught wire, such as when the wire is cut, vertex 126 moves toward the left in FIG. 15, and cone 120 moves downwardly. In either event, upon downward movement of cone 120, magnet 132 engages a contact within switch 118 and opens switch 118. Opening of switch 118 creates an alarm condition which is transmitted to transmitter 50, by wires (not shown) as is known in the electronic arts. Transmitter then communicates the alarm condition to a central monitoring station via hardwire or wireless means.

Figure 17:
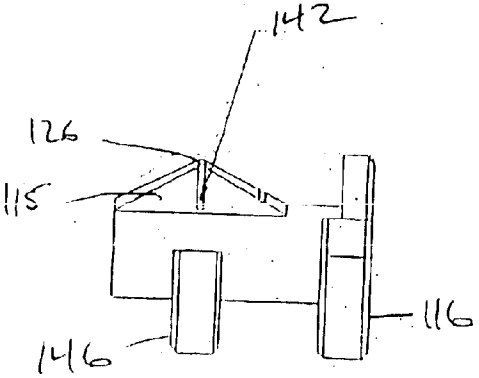
FIG. 17 is a side view of a spacer for use with the present invention.
Figure 18:
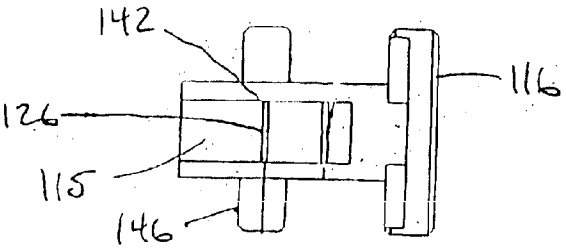
FIG. 18 is a top view of a spacer for use with the present invention.
Figure 16:
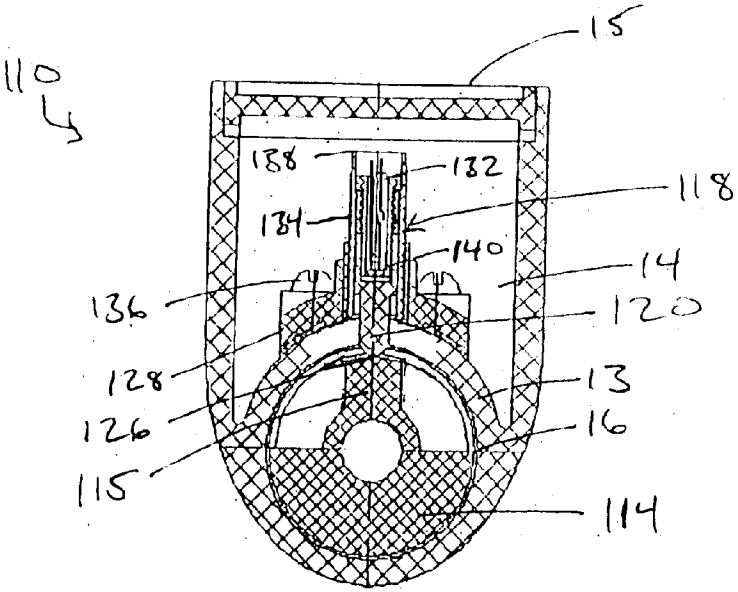
FIG. 16 is a front cross sectional view of a third embodiment of the tension sensing means of the present invention.

FIGS. 17 and 18 illustrate a side and top view of spacer 114, respectively. Spacer 114 includes an indicator marking 142, which allow the installer of the system to properly tension the device in-line with the taut wire. Since saddle 128 is made from transparent plastic material, providing an indicator line allows the installer to properly install the device on a taut wire, by visually checking the position of indicator markings 142, 144, while applying tension, i.e. tightening the taut wire, to the taut wire system. When properly tensioned, indicator marking 142 will be aligned with cone 120. Indicator marking 142 may be colored, such as red for example, to allow for easier viewing. Allowing the installer to visually check the tension of the system allows for ready installation of the taut wire security system of the present invention.

At the location of indicator marking 142, spacer 114 also preferably includes a groove or depression that engages cone 120, when the system is properly tensioned. The tip of cone 120 sits within the depression formed in the spacer, and is freely rotatable. The depression prevents cone 120 from extending downwardly and opening switch 118, due to small disturbances or changes in taut wire tension.

Figure 9:
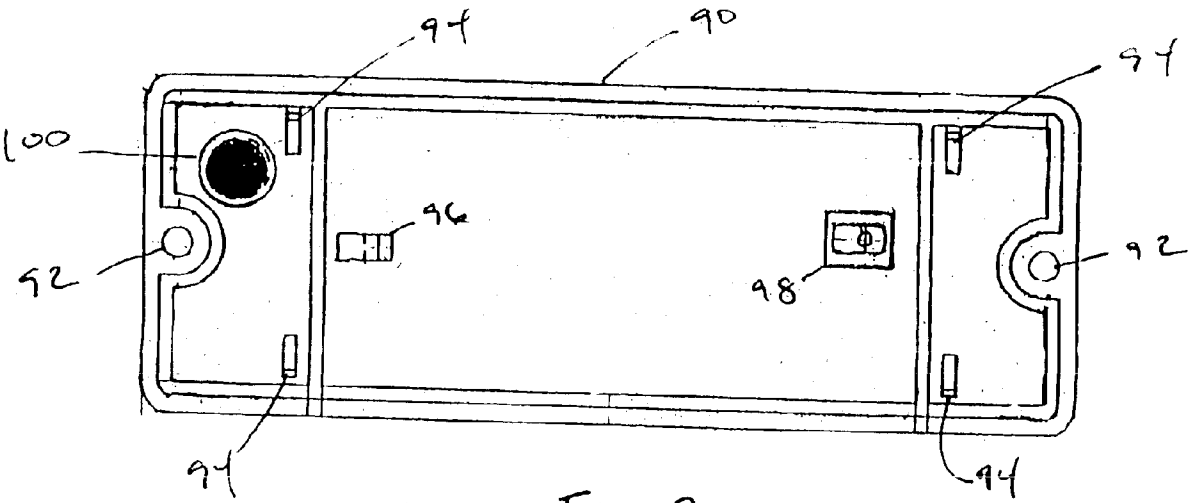
FIG. 9 is a top plan view of a lid plate of the present invention.
Figure 11:
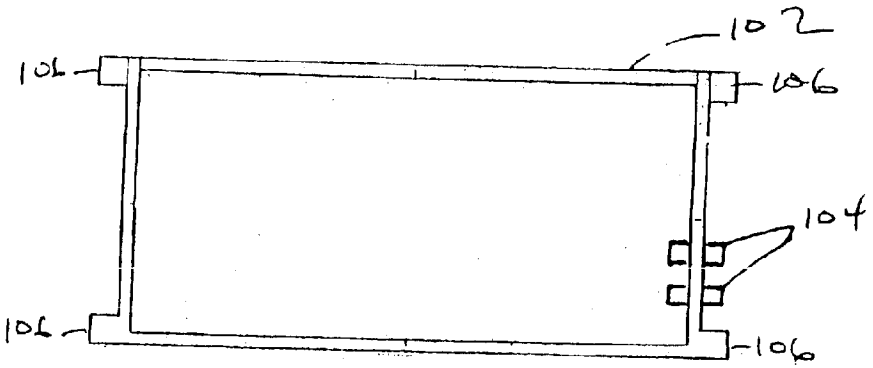
FIG. 11 is a top view of an electronic enclosure of the present invention.
Figure 12:
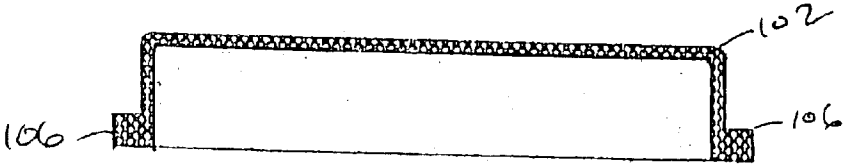
FIG. 12 is a front cross sectional view of an electronic enclosure of the present invention.
Figure 10:
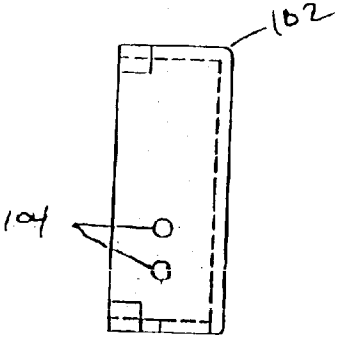
FIG. 10 is a side view of an electronics enclosure of the present invention.

As shown in FIG. 9, the taut wire security device of the present invention may also include a plate tampering detection sensor, which produces an alarm signal when plate 15 or 90 is removed from housing 12. Plate tampering detection sensor is placed within the electronics compartment 14, in position to sense when plate 15 or 90 (depending on which plate is in use) has been removed. As with the tension sensors, the plate tampering detection sensor electronically communicates with transmitter 50 to transmit an alarm condition to the central monitoring station. Either a general alarm signal, or a specific plate tampering signal may be transmitted to the monitoring station.

Various wireless transmitters known in the electronic arts may be utilized to transmit an alarm condition to a central monitoring station. The wireless transmitters may transmit the alarm condition over either a 811 MHz, 868 MHz, 900 MHz or 2.4 GHz frequency. Alternatively, the taut wire system of the present invention may be hard wired to the central monitoring station.

Figure 14:
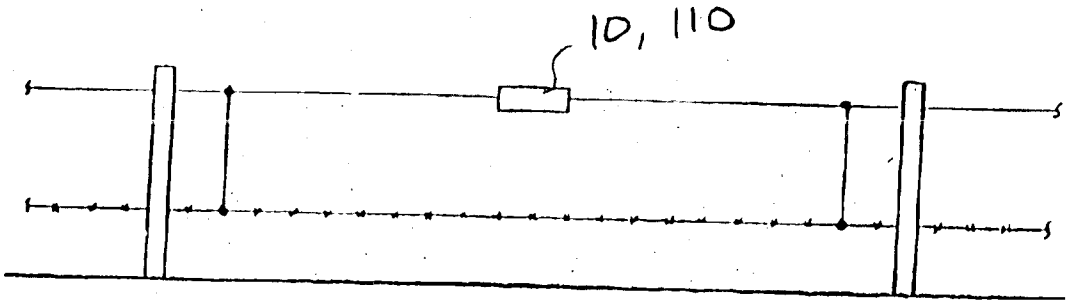
FIG. 14 is a diagrammatic view of the taut wire security system of the present invention in place on a perimeter fencing system.

In use, the taut wire security device of the present invention is utilized in a perimeter fencing system having a taut wire incorporated therewith, as shown in FIG. 14. One or more units of the present invention may be utilized, depending on the level of security required by the facility. An alarm condition is created by an intruder pulling or stepping on the taut wire, or cutting the taut wire completely. This causes the tension sensing means to indicate an alarm condition which is relayed from the transmitter 50 to a central monitoring station to notify security personnel of the disturbance, and the location of the disturbance.

The forgoing disclosure is illustrative of the present invention and is not to be construed as limiting thereof. Although one or more embodiments of the invention have been described, persons of ordinary skill in the art will readily appreciate that numerous modifications could be made without departing from the scope and spirit of the disclosed invention. As such, it should be understood that all such modifications are intended to be included within the scope of this invention. The written description and drawings illustrate the present invention and are not to be construed as limited to the specific embodiments disclosed.

What is claimed is:

1. A taut wire perimeter security system comprising:

a housing, said housing comprising a first compartment, a second compartment, a compartment divider between said compartments, and a lid selectively fastened to said housing for covering an opening in said housing;

said second compartment being separated from said first compartment and sealed from the atmosphere;

tension sensing means for monitoring the tension in a taut wire to produce a tension signal in response to a predetermined deviation in taut wire tension; and transmitting means for receiving the tension signal and for transmitting an alarm condition to a remote location in response to changes in the taut wire tension.

2. A taut wire perimeter security system as recited in claim 1, wherein said tension sensing means comprises:

a first rod extending from a first end of said first compartment and coupled to a first taut wire end;

a second rod extending from a second end of said first compartment and coupled to a second taut wire end;

a first magnet positioned about said first rod;

a second magnet positioned about said second rod;

a first biaser for biasing the first rod against normal wire tension;

a second biaser for biasing the second rod against normal wire tension;

a first reed switch housed within said second compartment substantially above said first magnet; and, a second reed switch housed within said second compartment substantially above said second magnet.

3. A taut wire perimeter security system as recited in claim 2, wherein said transmitting means is comprised of a radio transmitter.

4. A taut wire perimeter security system as recited in claim 2, wherein said housing further comprises:

an aperture formed in said first end of said first compartment;

an aperture formed in said second end of said first compartment;

a bushing placed within each of said first and second apertures, said bushings having a bore formed therein;

wherein said bushings are positioned upon said first and second rod.

5. A taut wire perimeter security system as recited in claim 4, wherein an o-ring is positioned about each of said bushings to prevent moisture from entering said first compartment through said apertures formed in said first and second ends of said first compartment.

6. A taut wire perimeter security system as recited in claim 4, wherein an o-ring is affixed within said bore of said bushings.

7. A taut wire security system as recited in claim 1, wherein said second compartment further comprises a breather valve.

8. A taut wire security system as recited in claim 1, further comprising a lid tampering detection means for producing a lid tampering signal when the lid is removed.

9. A taut wire security system as recited in claim 1, wherein said tension sensing means comprises:

a first rod extending from a first end of said first compartment and coupled to the taut wire;

a second rod extending from a second end of said first compartment and coupled to the taut wire;

a supporting structure including a plurality of guide members having stops on one end and connected to a first end plate at the other end;

a second end plate attached to the guide members and connected to said first rod;

a moveable end plate slideably attached to the elongated guide members between the first end plate and the second end plate, said moveable plate connected to said second rod;

biasing means for biasing said moveable end plate away from said first end plate against the normal longitudinal tension in the taut wire;

a first tension sensor element attached to said moveable plate; and, a second tension sensor element attached to the first end plate and adapted to produce the tension signal when the first tension sensor element moves out of a predetermined distance from the second sensor element.

10. A taut wire perimeter security system as recited in claim 9, wherein said transmitting means is comprised of a radio transmitter.

11. A taut wire perimeter security system as recited in claim 9, further comprising a lid tampering detection means for producing a lid tampering signal when the lid is removed.

12. A taut wire perimeter security system as recited in claim 9, wherein said housing further comprises:

an aperture formed in said first end of said first compartment;

an aperture formed in said second end of said first compartment;

a bushing placed within each of said first and second apertures, said bushings having a bore formed therein;

wherein said bushings are positioned upon said first and second rod.

13. A taut wire perimeter security system as recited in claim 12, wherein an o-ring is positioned about each of said bushings to prevent moisture from entering said first compartment through said apertures formed in said first and second ends of said first compartment.

14. A taut wire perimeter security system as recited in claim 12, wherein an o-ring is affixed within said bore of said bushings.

15. A taut wire perimeter security system as recited in claim 1, wherein said tension sensing means comprises:

a first rod extending from a first end of said first compartment and coupled to the taut wire;

a second rod extending from a second end of said first compartment and coupled to the taut wire;

a spacer positioned upon said first rod, said spacer comprising a cam having a vertex;

a biasing member positioned upon said first rod for biasing said first rod against the normal longitudinal tension in the taut wire;

a switch housing affixed to said compartment divider within said second compartment;

a magnetic reed switch housed within said switch housing and comprising a cone, a magnet and spring member, said spring member engaging said cone, and said cone adapted to selectively protrude through an aperture formed in said compartment divider;

wherein said cam vertex engages said cone to selectively force cone upwardly against said spring member.

16. A taut wire perimeter security system as recited in claim 15, wherein said transmitting means is comprised of a radio transmitter.

17. A taut wire perimeter security system as recited in claim 15, further comprising a lid tampering detection means for producing a lid tampering signal when the lid is removed.

18. A taut wire perimeter security system as recited in claim 15, wherein said housing further comprises:

an aperture formed in said first end of said first compartment;

an aperture formed in said second end of said first compartment;

a bushing placed within each of said first and second apertures, said bushings having a bore formed therein;

wherein said bushings are positioned upon said first and second rod.

19. A taut wire perimeter security system as recited in claim 18, wherein an o-ring is positioned about each of said bushings to prevent moisture from entering said first compartment through said apertures formed in said first and second ends of said first compartment.

20. A taut wire perimeter security system as recited in claim 18, wherein an o-ring is affixed within said bore of said bushings.

21. A taut wire perimeter security system as recited in claim 15, wherein said switch housing is constructed from transparent material.

22. A taut wire perimeter security system as recited in claim 15, wherein said switch housing further comprises legs which extend through said aperture formed in said compartment divider.

23. A taut wire perimeter security system as recited as claim 21, wherein said spacer further comprises at least one indicator marking as an aid during installation of the system.

24. A device for detecting tension deviations in at least one taut wire, comprising:

a first mechanical connection to a first wire end, a first biaser opposing the normal tension in the first wire end, and a first magnet operably associated with the first mechanical connection;

a second mechanical connection to a second wire end, a second biaser opposing the normal tension in the second wire end, and a second magnet associated with the second mechanical connection;

a first reed switch operably associated with the first magnet; and a second reed switch operably associated with the second magnet.

* * * * *